US006126474A

United States Patent [19]

Doye et al.

[11] Patent Number: 6,126,474

[45] Date of Patent: Oct. 3, 2000

[54] RETROFIT LATCHING SHROUD FOR BACKPLANE APPLICATIONS

[75] Inventors: Dennis Lee Doye, Maumelle; Michael J. Miskin, Little Rock, both of Ark.

[73] Assignee: Molex Incorporated, Lisle, Ill.

[21] Appl. No.: 09/235,951

[22] Filed: Jan. 22, 1999

[51] Int. Cl.[7] ..... H01R 13/627

[52] U.S. Cl. ..... 439/357; 439/350

[58] Field of Search ..... 439/357, 377, 439/358, 368, 634, 715, 712, 633, 638, 676, 677, 680, 682, 701, 716, 724, 355, 681

[56] References Cited

U.S. PATENT DOCUMENTS

| | | | |
|---|---|---|---|
| 4,090,764 | 5/1978 | Malsby et al. | 339/103 |
| 4,204,737 | 5/1980 | Faber et al. | 439/377 |
| 4,653,828 | 3/1987 | Szczesny et al. | 339/91 |
| 4,998,884 | 3/1991 | Ishikawa et al. | 439/49 |
| 5,147,226 | 9/1992 | Kile | 439/680 |
| 5,151,049 | 9/1992 | Mosquera | 439/353 |
| 5,161,996 | 11/1992 | Locati | 439/374 |
| 5,186,645 | 2/1993 | Bixler | 439/358 |
| 5,431,573 | 7/1995 | Endo et al. | 439/157 |

*Primary Examiner*—Paula Bradley
*Assistant Examiner*—Ross Gushi
*Attorney, Agent, or Firm*—A. A. Tirva

[57] ABSTRACT

A latching shroud for use on a backplane connector is provided which has an integrated a retention feature. The backplane connector includes a receptacle portion that receives a plurality of mating connectors therein and the latching shroud includes a pair of sidewalls that slip over and engage the connector around the receptacle portion thereof. A plurality of series of latching arms are formed in one of the sidewalls of the latching shroud, while polarizing elements are formed with the other sidewall of the latching shroud. The polarizing elements assist in orienting the mating connectors and the latching arms extend up and partly over the connector receptacle. The latching arms include hook end portions that grip the top surfaces of the mating connectors to retain them in place in the connector receptacle.

19 Claims, 3 Drawing Sheets

"D"
"C"

RETROFIT LATCHING SHROUD FOR BACKPLANE APPLICATIONS

BACKGROUND OF THE INVENTION

The present invention relates generally to connectors suitable for backplane applications and, more particularly, to a shroud having latching means integrally formed therewith, for converting an existing backplane connector to one having an integrated latching means.

Backplane connectors are electrical connectors that are mounted on a backplane of an electrical apparatus or electronic device. Typically, such backplane connectors have a receptacle-style configuration that defines one or more sockets that accommodate a like number of plug-style, opposing connectors. Often, the plug-style connectors accommodated in a backplane connector are themselves connected to a wire harness having various wire ends terminated to plug-style connectors, such as mini-coaxial connectors.

It is desired to maintain the plug-style connectors in engagement with the backplane connector. However, it is common that neither the backplane connector nor the plug-style connector have any means associated therewith to retain the plug-style connector in engagement with the backplane connector. In the past, retention of the plug-style connectors in the backplane connector has depended on frictional interference developed between the electrical contacts of the two connectors. The mating and backplane connectors are mated for long periods of time, and the plug-style connectors cannot be permanently secured to the backplane connectors because of the need to interchange, replace or repair the mating and/or backplane connectors, or the wire harnesses to which they are attached. The connectors remain engaged to the backplane connectors under varying environmental situations. For instance, the plug-style connectors may be subject to vibrations, thermal cycling or undesirable movement which may cause them to loosen, and in some situations, actually work free from engagement with the backplane connector.

These connector systems involving a backplane connector and multiple mating connectors are small and any such latching means associated therewith must be reliable. One such latching means is described in U.S. Pat. No. 5,186,654, issued Feb. 16, 1993, and assigned to the assignee of this application describes a latching system having a separate latching member associated with a backplane connector. The latching member is mounted adjacent to the backplane connector and contains a plurality of individual latching members that rise up over the backplane connector to retain the mating connectors in place. Although effective in retaining the mating connectors, the latching member is a separate member and must be molded separately, which increases the cost of the latching system. Also, because the latching member must be mounted to the backplane, it takes up valuable space on the backplane that could otherwise be used for additional electronic components.

Another latching system is described in U.S. Pat. No. 4,653,828, issued Mar. 31, 1987, which discloses a pin header that is used on a backplane and which connects to a separate flexible circuitry connector. Individual latch members are provided that interfit in openings of two opposing, and adjacent connector components to hold the connectors together. These latch members are rather small and hence are prone to loss and/or damage during use and installation. The structure of this latching system is delicate and an assembler must carry a supply of extra latching members to ensure proper assembly. The connector structure disclosed in this patent does not lend itself to retrofit applications, where it is desired to convert an existing backplane connector into one having an integrated latching aspect which does not take up additional space on the backplane.

A need therefore exists for a conversion element having an integrated connector retention aspect system that is simple in construction and which can be easily manufactured. The present invention is directed to an improved backplane connector that has a mating connector retention means integrated therewith and which overcomes the aforementioned disadvantages.

SUMMARY OF THE INVENTION

It is therefore a general object of the present invention to provide a shroud for a backplane connector, the shroud having a mating connector retaining means integrated therewith, for converting the backplane connector into a backplane connector with an integrated mating connector retaining means.

It is another object of the present invention to provide a latching shroud for a backplane connector, the latching shroud having a shroud body with a hollow interior that matches a receptacle portion of the backplane connector for accommodating a plurality of mating connectors in the shroud and in engagement with conductive terminals of the backplane connector, the shroud having a mounting surface that straddles the existing backplane connector and the shroud further having a plurality of latching arms integrally formed therewith that extend above and adjacent to the backplane connector receptacle portion in a manner such that they respectively single ones of the mating connectors in place within the receptacle portion.

It is still another object of the present invention to provide an improved latching shroud for converting a connector having a receptacle portion that receives a plurality of opposing mating connectors, such as a backplane connector into a connector having a mating connector latching aspect integrated therewith, the latching shroud including a hollow body portion having an interior opening that matches the opening of the connector receptacle portion for receiving therein a plurality of opposing mating connectors, the shroud body having a plurality of latching arms corresponding in number to the number of mating connectors accommodated by the connector receptacle, the latching arms being vertically cantilevered with respect to the shroud body, and having engagement heads that engage at least one surface of a corresponding mating connector approximately along the centerlines of the mating connectors, the shroud body further including a stop for limiting the extent of the deflection of the latching arms during insertion of the mating connectors into the connector receptacle.

Another object of the present invention is to provide a latching shroud for a backplane connector, wherein the backplane connector includes an elongated header portion having two parallel connector body walls defining a receptacle that receives a plurality of conductive terminals extending up from the backplane, the latching shroud having at least two parallel sidewalls separated by an intervening space that houses the backplane terminals and that defines an open space that matches the backplane connector receptacle, one of the latching shroud sidewalls having a plurality of polarizing members that engage complementary polarizing members of the mating connectors to orient the mating connectors in proper orientation lengthwise within the latching shroud, and the other of the latching shroud sidewalls having a plurality of erect latching arms that extend upwardly adjacent to the receptacle, each of the latching members having a latching face that extends above the backplane connector receptacle and which engages a corresponding mating connector accommodated within the backplane connector receptacle.

These objects are accomplished by certain principal aspects of the present invention. In one principal aspect of the present invention, the shroud includes an elongated body portion that is provided with a plurality of latching members that rise up from the body portion and which are spaced apart along the length of the connector in a spacing so that a single latching member is associated with a single mating connector. The latching members have free ends with engagement portions thereon, preferably in the form of hook ends with respective engagement surfaces that oppose and engage top surfaces of mating connectors inserted into the connector receptacle.

In another principal aspect of the present invention, the shroud body portion has guide rails associated therewith that engage the sidewalls of the backplane connector to which the latching shroud is attached. The guide rails engage the connector sidewalls and prevents them from spreading out during installation. Additionally, the walls of the latching shroud effectively increase the height of the backplane connector sidewalls and thereby prevents stubbing and damage to the backplane connector conductive pins when the mating connectors are inserted into the connector-shroud assembly.

In yet another principal aspect of the present invention, the latching arms are formed along one of the walls of the latching shroud body and have slots formed int he shroud body walls that flank the latching arms. These slots effectively increase the extent of the vertical cantilevered bodies of the latching arms to increase their flexibility so that the latching arms may easily deflect during insertion of mating connectors into the connector receptacle. In order to prevent the latching arms from being deflected too much and creating a detrimental overstress condition, the latching shroud body includes a latching arm stop that extends along the length of one wall in proximity to the latching arms. This stop may take the form of an elongated bar segment and stops the movement of the latching arms during insertion and removal of mating connectors from the connector receptacle.

In still another principal aspect of the present invention, the latching shroud body portion is provided with an integrated polarizing aspect that properly orients the mating connectors in place prior to their entry into the connector receptacle. This polarizing aspect includes a plurality of polarizing members, such as slots or recesses formed in a sidewall of the connector that lies opposite the latching arms. These slots accommodate complementary polarizing ribs formed on the mating connectors. Still further, the sidewalls of the connector may have additional slots, or may be configured to accommodate the arms of a mating connector insertion tool.

These and other objects, features and advantages of the present invention will be clearly understood through a consideration of the following detailed description.

BRIEF DESCRIPTION OF THE DRAWINGS

In the course of the following detailed description reference will be made to the attached drawing wherein like reference numerals identify like parts and wherein.

DETAILED DESCRIPTION OF THE PREFERRED EMBODIMENT

Figure 6:
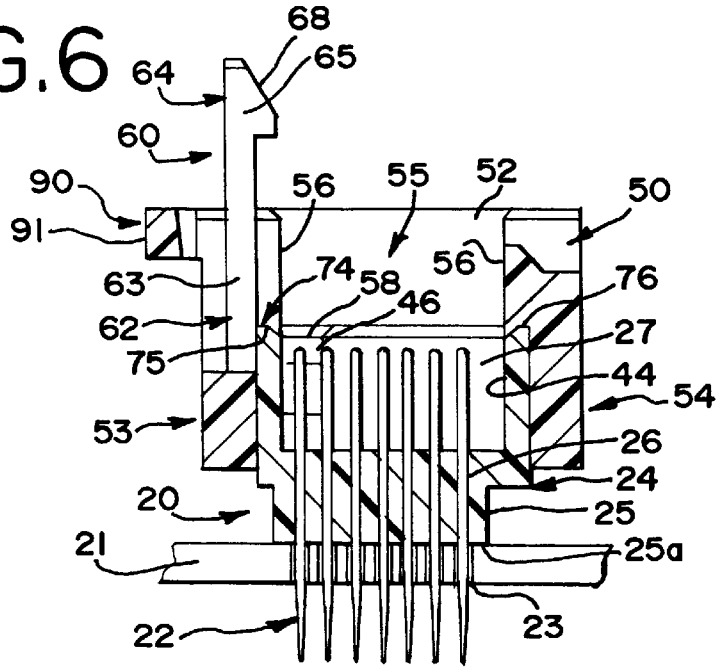
FIG. 6 is the same cross-sectional view of the latching shroud as FIG. 5, but illustrating the latching shroud in place on a backplane connector to form a shrouded connector assembly.

The present invention is particularly useful with backplane connectors. As shown in FIG. 6, a backplane connector 20 is applied to a backplane, such as a planar circuit board 21. The backplane connector 20 houses a plurality of conductive terminals 22, that typically have the form of elongated, conductive pins, that are held within a corresponding plurality of holes 23 formed in the backplane 21. The conductive pins 22 have extents that commonly extend in opposing directions on opposite sides of the backplane 21. One such extent is within the backplane connector 20.

Figures 7, 8, 9:
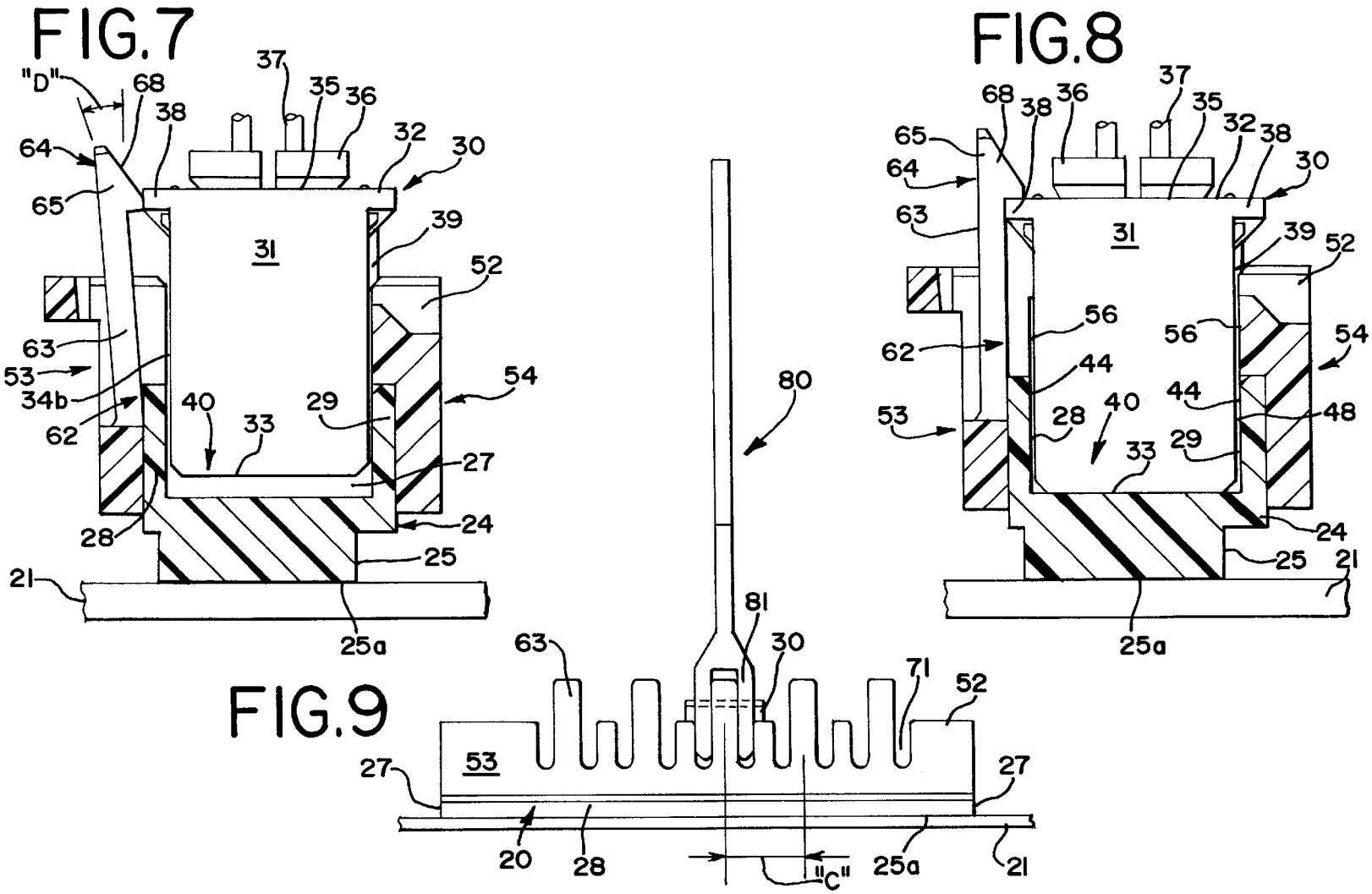
FIG. 7 is a cross-sectional view of a shrouded connector assembly similar to that of FIG. 6, but illustrating a mating connector partially in place therein and with the conductive terminals removed for clarity.
FIG. 8 is a cross-sectional view similar to that of FIG. 7, but illustrating the mating connector fully in place within the backplane connector and engaged by a latching member of the latching shroud, also with the conductive terminals removed for clarity.
FIG. 9 is an elevational view of the connector of FIG. 1 showing an installation tool in engagement therewith.

The connector 20 is provided for mating with a plurality of mating connectors 30, each having an insulative housing 31 that is dimensioned to engage the backplane connector 20. (FIGS. 7–9.) The mating connector housing 31 may have, as illustrated, opposing top and bottom surfaces 32 and 33, respectively, and which are interconnected by a plurality of connector sidewalls 34. The mating connector housings 31 also include openings, or passages 35, that extend through the connector housing 31 between the top and bottom surfaces 32, 33 thereof.

These mating connector openings 35 receive, in the lower portions thereof, the conductive pins 22, and in their upper portions, wire terminating modules 36, each of which may contain a terminated end of a mini-coaxial wire 37, with two terminations typically being found in each terminating module 36.

In typical applications, the backplane connector 20 will receive a plurality of these mating connectors 30 aligned therewith in side-by-side fashion longitudinally along the connector 20. When so received the coaxial cable terminations that are present in the lower portions of the mating connector passages 35 will engage the conductive terminals 22 of the backplane 21, or of the backplane connector 20 in instances where the terminals 22 are part of the backplane connector 20.

The top of the mating connector housing 31 can include, in proximity to, or adjacent with the top surface 32 thereof, a horizontal lip 38 that extends along at least one side of the connector housing 31, even though two such lips 38 are illustrated in FIGS. 7 & 8. Inasmuch as it is desirable to properly connect the mating connectors 30 to the conductive pins 22 enclosed within the backplane connector 20 in a proper orientation, the mating connector housing 31 also includes a polarizing element, shown as a vertical rib 39 that is formed along one of the connector housing sidewalls 33*a*.

The backplane connector 20 accommodates a plurality of the mating connectors 30 and thereby provides a connector interface between the mating connectors 30 and the backplane 21 and its associated conductive pins 22. The backplane connector 20 may be structured so as to accommodate any preselected number of mating connectors 30 therein. In this regard, the backplane connector 20 has an elongated connector housing 24 formed from an insulative and dielectric material. As seen best in FIG. 6, the connector housing 24 typically includes a perforated base portion 25 having a plurality of openings 26 formed therein in a preselected pattern and spacing that matches that of the backplane conductive pins 22 so that in instances where the conductive pins 22 are first inserted into the backplane holes 23, the connector housing 24 may be placed over the conductive pins 22 so that the lower surface 25*a* of the connector housing 24 lies in contact with the backplane 21.

The backplane connector 20 will typically includes a pair of endwalls 27 and two sidewalls 28, 29 that extend around the perimeter of the base portion 25 in order to cooperatively define a receptacle portion 40 for the connector 20. The endwalls 27 may be provided with openings that receive screws, or other mounting hardware, in order to affix the connector 20 to the backplane 21.

As shown in FIGS. 7 & 8, this receptacle portion 40 of the backplane connector receives the mating connectors 30. The present invention is directed to a accessory for use with backplane connectors 20 in order to convert the connectors 20 into one having an integrated mating connector latching aspect with a plurality of latches that engage and retain the mating connectors 30 in place within the connector receptacle 40. In this regard, the present invention provides a separate latching shroud 50 that is constructed to be applied to an existing backplane connector 20 and give the backplane connector 20 an integrated latching aspect by way of a retrofit application.

Figure 1:
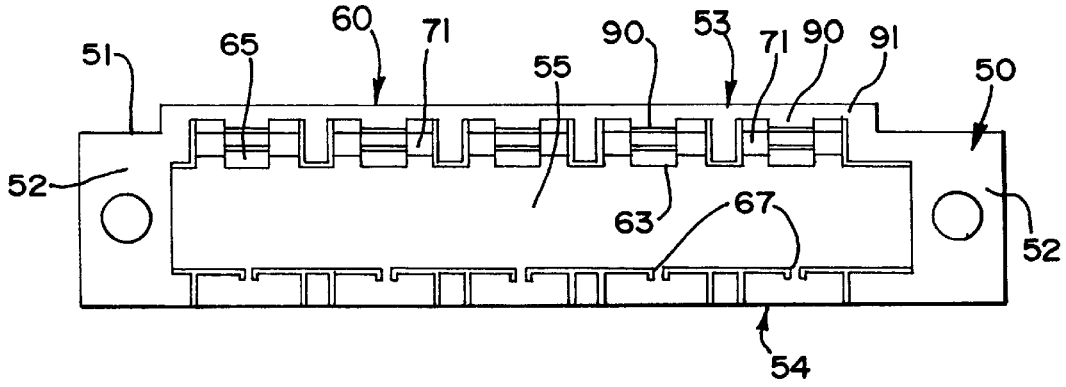
FIG. 1 is a top plan view of a latching shroud having an connector latching means integrated therewith constructed in accordance with the principles of the present invention.
Figure 2:
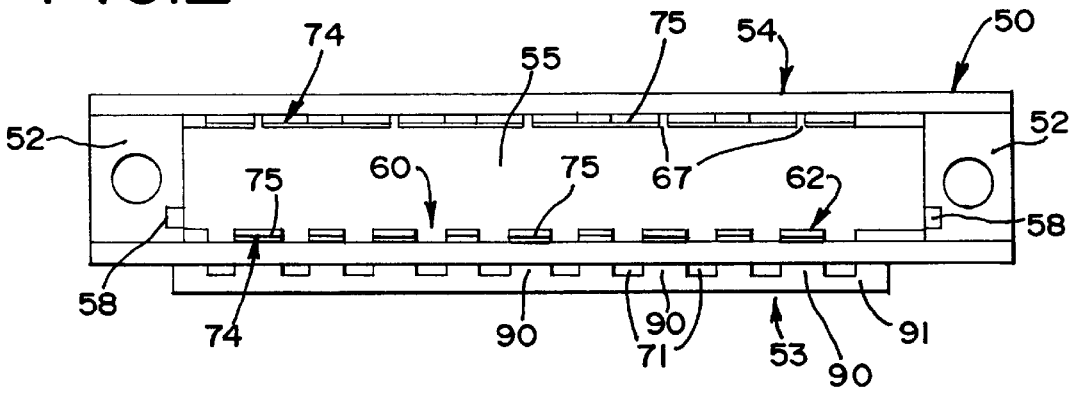
FIG. 2 is a bottom plan view of the latching shroud of FIG. 1.
Figure 3:
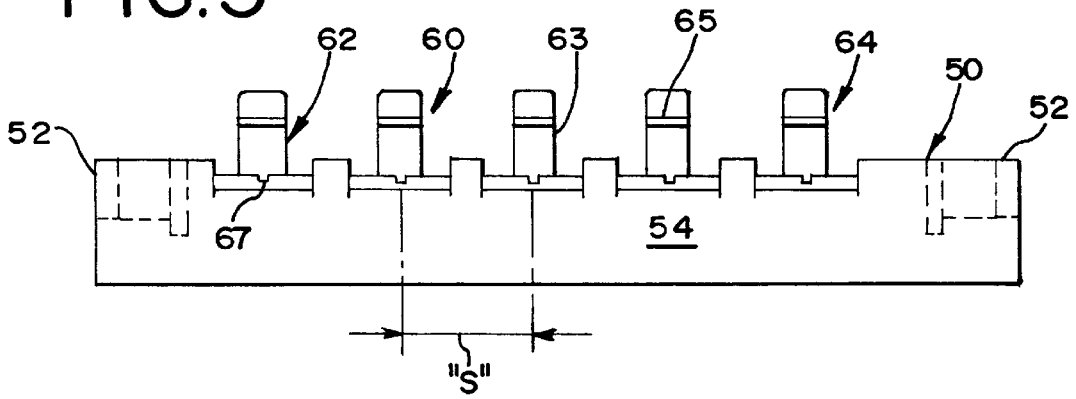
FIG. 3 is an elevational view of the latching shroud of FIG. 1, taken along lines 3—3 thereof, and illustrating the latching side of the latching shroud.

The latching shroud 50, as illustrated in FIG. 1, includes an elongated, hollow body portion 51 having a pair of endwalls 52 and a pair of opposing sidewalls 53, 54. The endwalls 52 and the two sidewalls 53, 54 cooperate to define a central opening 55 that has approximately the same dimensions as the receptacle portion 40 of the backplane connector 20. As seen in FIG. 6, the walls 52–54 of the shroud 50 serve to increase the height of the sidewalls and endwalls of the backplane connector 20, and thus, the shroud 50 may be aptly considered as an extension member that interfits with the backplane connector 20. This extension aspect is beneficial in that the increased height of the backplane connector sidewalls effectively protects the conductive pins 22.

In an important aspect of the present invention, the latching shroud 50 includes means 60 for retaining the mating connectors 30 in place within the receptacle portion 40 of the backplane connector 20. As shown in the Figures, this mating connector retention means includes a plurality of retaining members 62 that are shown integrally formed with one 53 of the two sidewalls of the shroud 50. These retaining members 62 extend along the one sidewall 53 of the connector housing 21.

Figure 4:
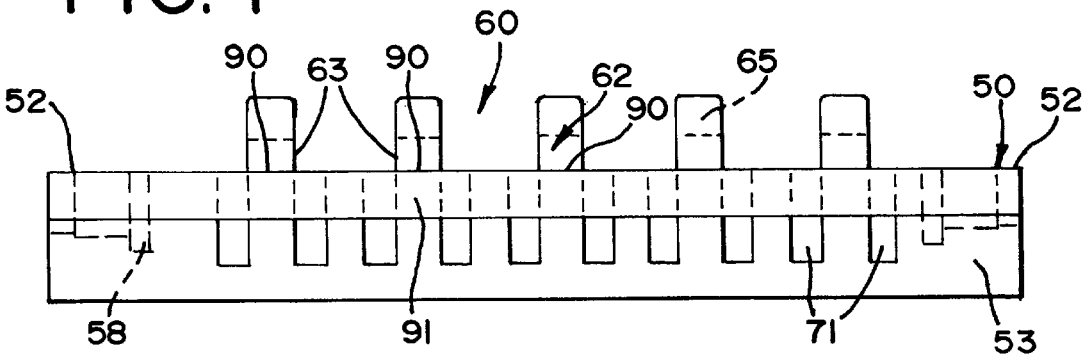
FIG. 4 is an elevational view of the latching shroud of FIG. 1, taken along lines 4—4 thereof, and illustrating the non-latching and polarizing side thereof.
Figure 5:
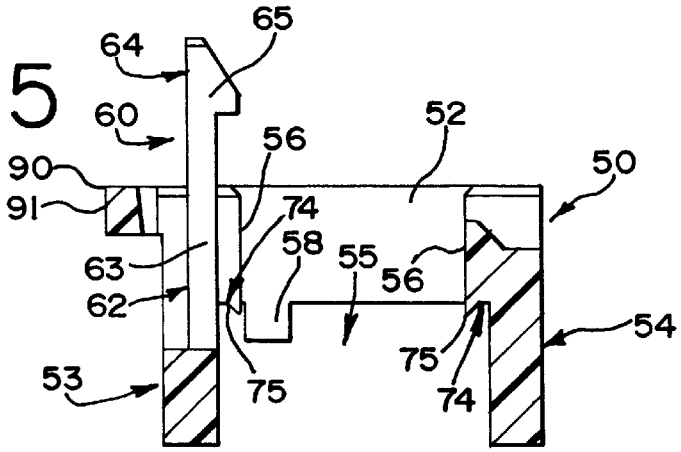
FIG. 5 is a cross-sectional view of the latching shroud of FIG. 1 and illustrating the body portion of the latching shroud.

The retaining members 62 are illustrated in the preferred embodiment as elongated latching arms 63 that are spaced along the one sidewall 53 in a spacing that corresponds to the spacing of the centerlines C of the mating connectors 30. (FIG. 4.) Preferably, a single latching arm 63 is associated with a single mating connector 30. The latching arms 63 extend upwardly and adjacent the receptacle portions 40 of the backplane connector 20 when the latching shroud 50 is applied to the backplane connector 20. The latching arms 63 have engagement portions 64, illustrated as hooks 65 positioned at the free ends 66 of the latching arms 63. As seen in FIG. 6, each hook 65 extends at least above the receptacle portion 30, and in some instances, to a limited extent over the connector receptacle portion 40.

In order to provide the latching shroud 50 with a polarizing aspect, and as shown in FIG. 4, the other sidewall 54 has polarizing members that are complementary in configuration to polarizing members 39 of the mating connectors 30 and which match similar polarizing members 48 formed in the connector receptacle 40. These features are illustrated in the preferred embodiment as slots, or channels 67, that are formed in the sidewall 54 and are spaced apart in a spacing S that is equivalent to the spacing of the polarizing elements 39 of adjacent mating connectors 30 received in the receptacle portion 40. These slots 67 serve to orient the mating connectors 40 longitudinally within the backplane connector 20. The polarizing slots 67 of the latching shroud permit the mating connectors 30 to be fully aligned with the conductive pins 22 of the backplane connector 20 before the mating connector actually engages the conductive pins 22. This prevents stubbing and possible damage to the conductive pins 22.

The latching arms 63 of the shroud 50, and especially the hook portions 65 thereof, serve to actually retain and latch the mating connectors 30 in place within the backplane connector 20 in a manner to resist them working free. The bottom faces of the latching arm hook portions 65 engage the top surfaces 32 of the mating connector 30, and particularly the side, horizontal ribs 38 thereof. The latching arms 63 are preferably spaced in a spacing as illustrated to locate them over and at centerlines of the mating connectors 30 so as to engage them in a balanced manner that does not impart any unequal retention force on the mating connectors that may compromise their connection to the backplane connector 20 and the conductive pins 22 arranged in the receptacle portion 40. Additionally, it is preferred that the hook portion bottom engagement surfaces also lie in a common, horizontal plane.

The latching arm hooks 65 have ramped portions 68 that define cam surfaces of the latching arms 63. As illustrated in FIG. 7, one sidewall 34*b* and the top engagement rib 38 of the mating connector 30 will engage and ride upon this cam surface 68, when the mating connector 30 is introduced into the connector receptacle portion 40. As the mating connector 30 moves deeper into the receptacle portion 40, it forces the corresponding latching arm 63 to deflect outwardly, until the hook portion 65 engages and rides up and over the mating connector engagement rib 68 and onto the top surface thereof. The maximum deflection D of the latching arms 63 is illustrated in FIG. 7.

The length of the latching arms 63 has an effect on their resiliency as does the material from which they are made. In order to supplement the resiliency of the latching arms 63, a series of slots, or notches 71 may be provided in the latching shroud 50 and are preferably formed in the latching sidewall 53 of the shroud 50. As illustrated in FIGS. 4 & 9, these slots 71 are arranged adjacent to and flanking the latching arms 63. The slots 51 serve to increase the height of the latching arms 63 and, in effect, increase the length of their cantilevered, upward extent, thereby increasing the flexibility of the latching arms 63. These slots 71 also facilitate the installation of the mating connectors 30 in the backplane connector 20 by providing spaces that receive extending gripping arms 81 of a mating connector installation tool 80. (FIG. 9.) In this regard, the slots 71 preferably have a width that is at least slightly greater than the width of the installation tool gripping arms 81.

In order to prevent the latching arms from being deflected too much and place into an overstress condition, the shroud 50 includes a series of latching arm stops 90 that are positioned behind, or outwardly of the latching arms 33 with respect to the central opening 55 of the shroud 50. (FIG. 7.) As shown in FIG. 1, one stop 90 is associated with each latching arm 33, and the stops 90 are preferably formed integral with the second sidewall 53 of the shroud 50. They are shown in the preferred embodiment, especially in FIGS. 1 & 6 as an elongated rail, or bar, 91 that extends for the length of the shroud 50.

When applied to the backplane connector 20, the latching shroud 50 straddles the backplane connector 20 in a manner such that its two sidewalls 53 & 54 align and mate with the two sidewalls 28 & 29 of the backplane connector 20. This alignment is best shown in FIGS. 6–8. The bottom surfaces 74 of the interior portions of the latching shroud sidewalls 53, 54 are preferably provided with grooves 75 that engage opposing surfaces 76 of the backplane connector sidewalls 28, 29. In the preferred embodiment, this engagement is shown as a "shiplap" type construction wherein the interior surfaces 56 of the latching shroud 50 abut and align with the interior surfaces 44 of the backplane connector receptacle portions 40. This construction prevents the latching shroud sidewalls 53, 54 from flexing outwardly during installation or during use.

In order to properly orient the latching shroud 50 on the backplane connector 20, the latching shroud 50 may be provided with one or more orientation tabs 58 that are received in complementary slots 46 formed in the backplane connector 20. These tabs and slots 58, 46 are located at opposite ends of the connector and latching shroud. This prevents the latching shroud from being installed improperly on the backplane connector 20.

While the preferred embodiment of the invention have been shown and described, it will be apparent to those skilled in the art that changes and modifications may be made therein without departing from the spirit of the invention, the scope of which is defined by the appended claims.

We claim:

1. A latching shroud for mounting on a backplane connector and for converting the backplane connector to a backplane connector having an integrated latching means, said backplane connector having a connector housing with two endwalls and two opposing sidewalls, the connector housing endwalls and sidewalls cooperatively defining a backplane connector receptacle that is adapted to receive a plurality of mating connectors therein, the backplane connector receptacle having defined perimeter, each of the mating connectors having opposing top and bottom surfaces, the mating connector top and bottom surfaces being interconnected by at least two mating connector sidewalls, said latching shroud comprising:

an insulative latching shroud body adapted for attachment to said backplane connector housing, the latching shroud body portion having a perimeter that approximately matches the perimeter of said backplane connector receptacle, the latching shroud body including first and second opposing sidewalls of a preselected height and which are separated by an intervening open space, said latching shroud first and second sidewalls cooperatively defining therebetween an extension of said connector receptacle for receiving a plurality of said mating connectors therein in side-by-side order, when said latching shroud is applied to said backplane connector;

said latching shroud first sidewall having a plurality of polarizing elements disposed thereon, a single polarizing element being associated with a single mating connector, said polarizing elements engaging opposing and complementary polarizing elements disposed on said mating connectors to thereby orient said mating connectors in said side-by-side order within said connector receptacle and said connector receptacle extension;

said latching shroud second sidewall having a plurality of retention elements integrally formed therewith and spaced apart from each other lengthwise along said latching shroud second sidewall, a single retention element being associated with a single mating connector received within said connector receptacle extension, said latching shroud retention elements having free ends that engage opposing surfaces of said mating connectors to thereby retain them in place and at a preselected level within said connector receptacle extension and;

wherein one of said backplane connector sidewalls includes a plurality of polarizing elements disposed thereon which are identical in shape to said latching shroud first sidewall polarizing elements, said latching shroud first sidewall polarizing elements being aligned with said backplane connector first sidewall polarizing elements when said latching shroud is applied to said backplane connector.

2. The latching shroud as defined in claim 1, wherein said latching shroud body portion incudes grooves formed on bottom surfaces of at least said latching shroud first and second sidewalls, the grooves receiving said backplane connector sidewalls therein when said latching shroud is applied to said backplane connector.

3. The latching shroud as defined in claim 1, wherein said latching shroud retention elements deflect partially outwardly in response to initial insertion of said mating connectors into said backplane connector receptacle, said latching shroud second sidewall further includes a plurality of slots formed therein, two of the slots flanking each latching shroud retention element and thereby increasing the deflectability of said latching shroud retention elements, and said latching shroud body portion including a plurality of stops disposed outwardly of said latching shroud retention elements, said stops limiting deflection of said latching shroud retention elements.

4. The latching shroud as defined in claim 1, wherein said latching shroud retention elements deflect partially outwardly in response to initial insertion of said mating connectors into said backplane connector receptacle, and said latching shroud body portion includes a elongated stop member disposed thereon outwardly of said latching shroud retention elements for limiting deflection of said latching shroud retention elements.

5. The latching shroud as defined in claim 1, wherein each of said latching shroud retention elements are further disposed adjacent one of said backplane connector sidewalls when said latching shroud is applied to said backplane connector, said latching shroud retention elements further extending upwardly away from said backplane connector and said retention element free ends extending at least adjacent said connector receptacle.

6. The latching shroud as defined in claim 5, wherein said latching shroud retention elements include elongated latching arms and said free ends thereof include hook portions disposed at ends of the latching arms.

7. The latching shroud as defined in claim 1, wherein said latching shroud retention elements free ends include hook portions that protrude adjacent said connector receptacle and overlie and engage said mating connector top surfaces when said mating connectors are present in said backplane connector receptacle, said latching shroud retention elements being spaced along said latching shroud second sidewall in a spacing such that each retention element hook end engages a corresponding mating connector top surface at a central portion of said mating connector top surface when said mating connectors are present in said backplane connector receptacle.

8. The latching shroud as defined in claim 7, wherein said retention elements are cantilevered upwardly with respect to said latching shroud body portion and wherein said hook portions of said latching shroud retention elements are all arranged in a common plane.

9. The latching shroud as defined in claim 1, wherein said latching shroud first sidewall polarizing elements include channels formed thereon and disposed on an interior surface of said latching shroud first sidewall, said backplane connector first sidewall polarizing elements also including channels formed thereon and on an interior surface of said backplane connector receptacle, said latching shroud and said backplane connector channels receiving corresponding opposing ribs formed on an exterior surface of said mating connectors.

10. The backplane connector as defined in claim 9, wherein said latching shroud and backplane connector channels are aligned together vertically, but are spaced apart lengthwise along said latching shroud and backplane connector so as to approximately coincide with centerlines of said mating connectors.

11. A latching shroud for mounting on a connector, the connector being adapted to receive and retain in engagement therewith a plurality of mating connectors, each of the mating connectors having opposing top and bottom surfaces that are interconnected by mating connector sidewalls, said connector further including an elongated housing having a pair of opposing endwalls defining ends of said housing and first and second opposing sidewalls extending between and interconnecting said housing endwalls together, the housing first and second sidewalls being separated by an intervening space that cooperatively defines a receptacle of said housing adapted to receive a plurality of said mating connectors therein in side-by-side order within said housing receptacle, the latching shroud comprising:

an elongated shroud body having two endwalls and first and second sidewalls extending therebetween to cooperatively define a central opening of approximately the same size as that of said housing receptacle, said shroud body being mateable to said connector housing whereby said shroud body endwalls and sidewalls form with said connector housing, an extended housing receptacle of said connector;

said shroud body first sidewall having a plurality of polarizing elements disposed thereon that are capable of engaging opposing and complementary polarizing elements disposed on said mating connectors to thereby orient said mating connectors in said side-by-side order within said extended housing receptacle;

said shroud body second sidewall having a plurality of latching arms integrally formed therewith and spaced apart along said housing second sidewall length, said latching arms having free ends that partially extend over said mating connectors when placed within said extended housing receptacle in order to engage opposing surfaces of said mating connectors to thereby retain them in place within said extended housing receptacle and;

wherein said latching arms are vertically cantilevered with respect to said shroud body, and said latching arms partially deflecting outwardly during insertion of said mating connectors into said extended housing receptacle, said shroud body including a stop disposed proximate to each of said latching arms for limiting deflection thereof.

12. The latching shroud as set forth in claim 11, wherein said latching arm free ends include hook portions that partially extend over said extended housing receptacle.

13. The latching shroud as set forth in claim 11, wherein said latching arms are spaced along said latching shroud second sidewall in a manner such that said latching arm engagement portions engage top surfaces of said mating connectors at approximately centerlines of said mating connector top surfaces when said mating connectors are present in said extended housing receptacle.

14. The latching shroud as set forth in claim 11, wherein said latching arm hook portions are all arranged in a common plane.

15. The latching shroud as defined in claim 11, wherein shroud body second sidewall further includes a plurality of slots formed therein, two of the slots flanking each latching arm, said slots effectively increasing the heights of said latching arms, and said shroud body first sidewall polarizing elements include channels formed in an interior surface of said shroud body first sidewall.

16. The latching shroud as defined in claim 12, wherein shroud body first and second sidewalls each include recesses a formed on bottom surfaces, the shroud body sidewall recesses receiving opposing top surfaces of said connector first and second sidewalls.

17. The latching shroud as defined in claim 16, wherein shroud body first and second sidewalls each have interior surfaces and said connector first and second sidewalls each have interior surfaces, said interior surfaces of said shroud body first and second sidewalls and said connector first and second sidewalls being aligned with each other when said connector first and second sidewall tops surfaces are received within said shroud body first and second sidewall recesses.

18. The connector of claim 17, wherein said housing first sidewall includes a plurality of polarizing elements disposed thereon that are capable of engaging opposing and complementary polarizing elements disposed on said mating connectors to thereby orient said mating connectors in said side-by-side order within said connector receptacle.

19. A latching shroud for extending a receptacle of a backplane connector, the receptacle being adapted to receive and retain in engagement therewith a plurality of mating connectors, the backplane connector having opposing endwalls and first and second sidewalls extending longitudinally between the backplane connector endwalls, the endwalls and sidewalls cooperatively defining said backplane connector receptacle that also receives a plurality 6f conductive pins therein for mating to said mating connectors, the latching shroud comprising:

a shroud body for attachment to said backplane connector for extending the height of said backplane connector endwalls and sidewalls to thereby increase the depth of said backplane connector receptacle;

the shroud body having two endwalls and first and second opposing sidewalls, said shroud body endwalls and sidewalls defining an interior opening of said shroud body of approximately same dimensions of said backplane connector receptacle, said shroud body second sidewall having a plurality of latching arms being integrally formed therewith and spaced apart in a pattern along a length of said shroud body second sidewall, the latching arms extending upwardly from said shroud body in a vertically cantilevered fashion so that said latching arms will deflect partially outwardly in response to initial insertion of said mating connectors into said backplane connector receptacle;

said latching arms having free ends that each include a hook end, the hook ends having engagement surfaces arranged so as to engage opposing top surfaces of said mating connectors to thereby retain them in place and at a preselected level within said backplane connector receptacle;

said shroud body further including a stop associated with each of said latching arms, the stop being spaced apart from said latching arm and disposed outwardly of said latching arm with respect to said shroud body opening, said stop limiting deflection of said latching arm.

* * * * *